US006983691B2

(12) United States Patent
Shih

(10) Patent No.: US 6,983,691 B2
(45) Date of Patent: Jan. 10, 2006

(54) RETRACTABLE STAMP

(76) Inventor: Shiny Shih, No. 31, Lane 349, Chungcheng S. Rd., Yungkang City, Tainan Hsien (TW)

( * ) Notice: Subject to any disclaimer, the term of this patent is extended or adjusted under 35 U.S.C. 154(b) by 0 days.

(21) Appl. No.: 10/760,731

(22) Filed: Jan. 20, 2004

(65) Prior Publication Data

US 2005/0155504 A1 Jul. 21, 2005

(51) Int. Cl.
*B41K 1/56* (2006.01)
*B41K 1/36* (2006.01)

(52) U.S. Cl. ..... 101/405; 101/103; 101/109

(58) Field of Classification Search ..... 101/333, 101/405, 406, 103, 109
See application file for complete search history.

(56) References Cited

U.S. PATENT DOCUMENTS 1,179,979 A * 4/1916 Troup ..... 101/371
1,353,994 A * 9/1920 Folger et al. ..... 101/103
4,181,560 A * 1/1980 Maitland ..... 156/542
4,649,819 A * 3/1987 Voto et al. ..... 101/327
5,115,729 A * 5/1992 Beckman et al. ..... 101/327
5,377,599 A * 1/1995 Wall et al. ..... 101/327
6,360,661 B1 * 3/2002 Cheung ..... 101/333

FOREIGN PATENT DOCUMENTS

EP 588730 A1 * 3/1994
GB 2204832 A * 11/1988
WO WO 200056552 A1 * 9/2000

* cited by examiner

*Primary Examiner*—Daniel J. Colilla
(74) *Attorney, Agent, or Firm*—William E. Pelton, Esq.

(57) ABSTRACT

A retractable stamp has a longitudinal spring with a tension that can be adjusted. The adjustable stamp has a housing, a base, a cover, a handle, an adjustment knob and a position ring. The housing has a character unit mounted inside, and the base is mounted on the housing. The cover is mounted outside the housing and the base, and the handle is connected to the cover. The longitudinal spring is mounted inside the handle and retracts the character unit into the cover. The adjustment knob is mounted rotatably in the handle, and the position ring holds the adjustment knob in place. When the adjustment knob is turned, the tension of the spring can be changed to make the character unit stamp a clear imprint.

13 Claims, 4 Drawing Sheets

RETRACTABLE STAMP

BACKGROUND OF THF INVENTION

1. Field of the Invention

The present invention relates to a stamp, and more particularly to a retractable stamp in which spring tension can be adjusted to make a clear imprint.

2. Description of Related Art

A retractable stamp has a housing, a spring and a character unit. The character unit is retracted into the housing and is used for stamping. The spring is also mounted inside the housing and holds the character unit in the housing. When the retractable stamp spring is too weak, the character unit will deform or distort, and the imprint on the surface will be too dense, distorted or deformed. When the retractable stamp spring is too strong, the retractable character unit may be kept from making full contact with the surface, and the stamp will be too light or incomplete. However, the tension of the spring inside the conventional retractable stamp varies with the age and use of the spring because the spring in the stamp is not adjustable.

The present invention provides a stamp to mitigate or obviate the aforementioned problem.

SUMMARY OF THE INVENTION

An objective of the present invention is to provide a retractable stamp in which the spring tension can be adjusted.

The adjustable stamp has a housing, a base, a cover, a handle, an adjustment knob and a position ring. The housing has a character unit mounted inside, and the base is mounted on the housing. The cover is mounted outside the housing and the base, and the handle is connected to the cover. A longitudinal spring is mounted inside the handle. The adjustment knob is mounted adjustably on the handle, and the position ring holds the adjustment knob in place.

When the adjustment knob is adjusted, the tension of the spring can be changed to make the character unit stamp a clear imprint.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
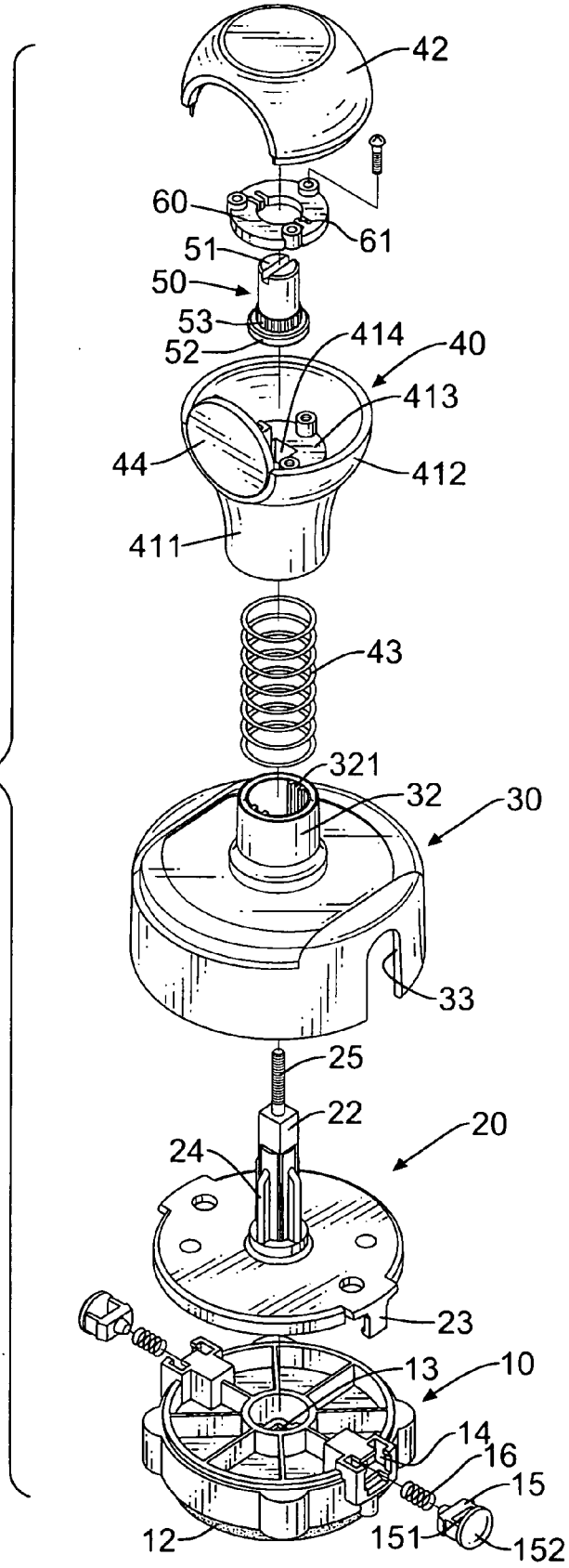
FIG. 1 is an exploded perspective view of a retractable stamp in accordance with the present invention.
Figure 3:
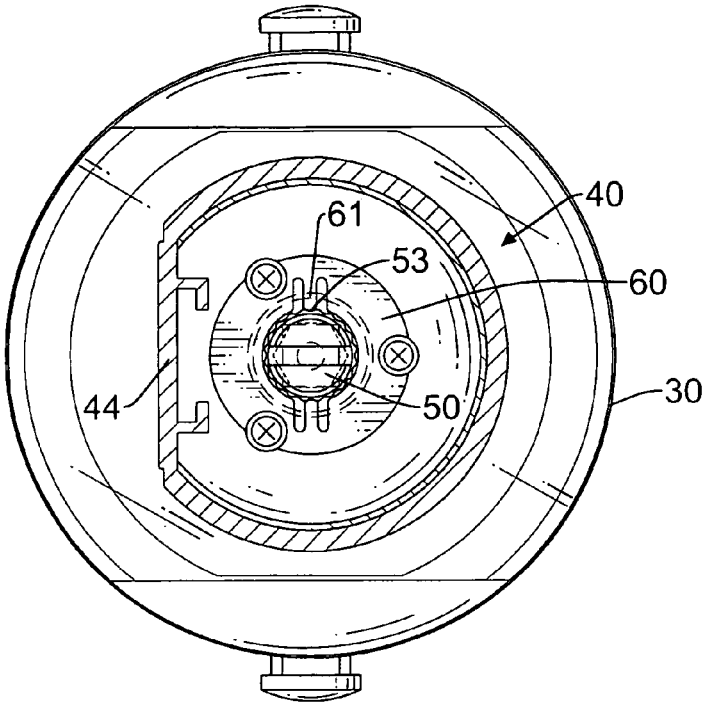
FIG. 3 is a cross sectional top plan view of the stamp along line 3—3 in FIG. 1.
Figure 2:
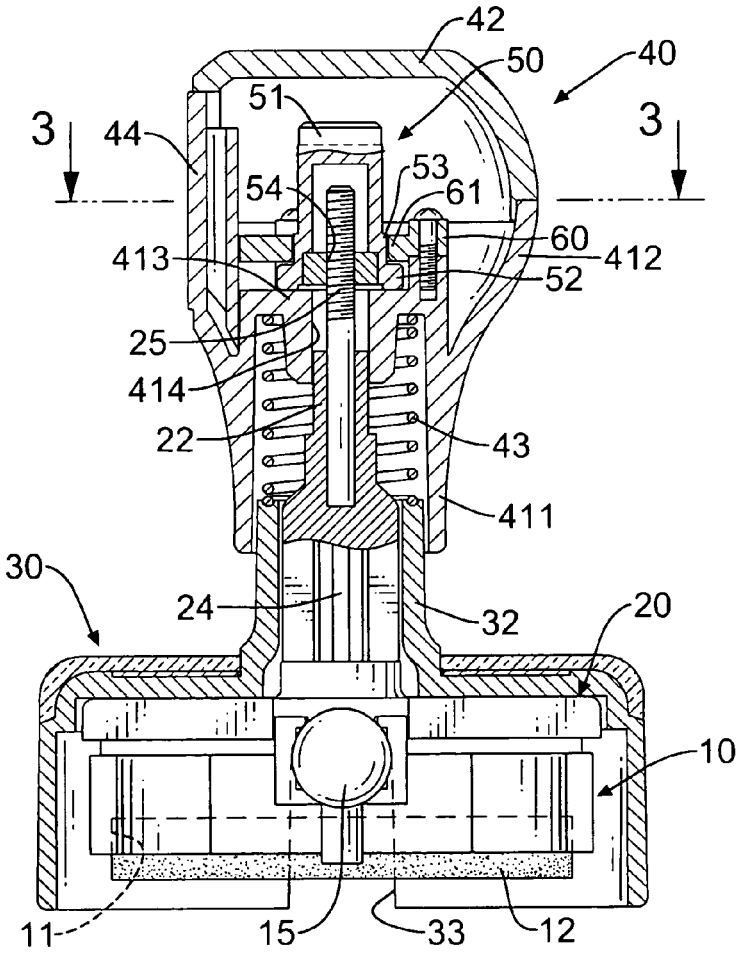
FIG. 2 is a side plan view in partial section of the stamp in FIG. 1.

With reference to FIGS. 1 to 3, a stamp in accordance with the present invention has a housing (10), a base (20), a cover (30), a handle (40), a adjustment knob (50) and an optional position ring (60).

The housing (10) has a bottom surface (not numbered), a top surface (not numbered), a side surface (not numbered), a center (not numbered), a bottom cavity (11), an ink-impregnated foam pad (not shown), a character unit (12), an ink fill opening (13), two optional peripheral chambers (14), two optional pushbuttons (15) and two optional springs (16). The bottom cavity (11) is defined in the bottom surface of the housing (10). The ink-impregnated foam pad is mounted inside the bottom cavity (11), and the character unit (12) is mounted on the ink-impregnated foam pad in the bottom cavity (11). The ink fill opening (13) is defined through the center of the housing (10) and communicates with the bottom cavity (11). The optional peripheral chambers (14) are defined on the side surface of the housing (10). In a preferable embodiment, the optional peripheral chambers (14) are diametrically opposite to each other. The optional springs (16) are mounted respectively inside the optional peripheral chambers (14), and each optional spring (16) has an inner end (not numbered) and an outer end (not numbered). The optional pushbuttons (15) are mounted respectively inside the optional peripheral chambers (14), and each optional pushbutton (15) has an inner end (not numbered), an outer end (not numbered), a keyhole (151) and a head (152). The inner ends of the pushbuttons (15) press respectively against the outer ends of the springs (16). The heads (152) are defined respectively on the outer ends of the pushbuttons (15), and the keyholes (151) are defined transversely respectively through the pushbuttons (15).

The base (20) is mounted on the housing (10) and has a top surface (not numbered), an upper side edge (not numbered), two optional latches (23), a center (not numbered), a drive rod (22), multiple optional keys (24) and a threaded post (25). The drive rod (22) is formed on the top surface at the center of the base (20), and has a top end (not numbered) and multiple side surfaces (not numbered). In a preferable embodiment, the drive rod (22) has a non-circular cross section (not numbered). The threaded post (25) is mounted on the top end of the drive rod (22). The optional keys (24) are formed respectively on the side surfaces of the drive rod (22). The optional latches (23) are formed on the upper side edge diametrically opposite to each other, extend toward the housing (10), are mounted respectively in the keyholes (151) in the pushbuttons (15) and respectively hook the corresponding pushbuttons (15).

The cover (30) is mounted on the housing (10) and the base (20) and has an inner cavity (not numbered), a top surface (not numbered), a center (not numbered), a side surface (not numbered), a tube (32) and two optional longitudinal U-shaped openings (33). The optional longitudinal U-shaped openings (33) are defined in the side surface and allow the corresponding pushbuttons (15) to extend through the side surface opposite to each other. The tube (32) is formed on the top surface at the center of the cover (30) and has an inner surface (not numbered), a top (not numbered) and multiple optional keyways (321). The multiple keyways (321) are formed inside the inner surface and correspond respectively to the optional keys (24) on the base (20).

The handle (40) is mounted slidably on the cover (30) and has a top portion (not numbered), a bottom portion (not numbered), an optional cap (42), a tubular neck (411) and a longitudinal spring (43). The optional cap (42) is mounted on the top portion of the handle (40), and the tubular neck (411) is formed on the bottom portion of the handle (40). The tubular neck (411) has a top end (not numbered), a bottom end (not numbered), a side surface (not numbered), a cavity (412), a bottom surface (413), a central hole (414) and an optional label tab (44). The tubular neck (411) is mounted slidably on the tube (32) of the cover (30), and the longitudinal spring (43) is mounted inside the tubular neck (411) between the top end of the tubular neck (411) and the top of the tube (32) on the cover (30). The cavity (412) is defined on the top end of the tubular neck (411). In a preferable embodiment, the cavity (412) is a bowl-shaped cavity. The central hole (414) is defined through the bottom surface (413) and allows the drive rod (22) to pass moveably through the tubular neck (411). The central hole (414) of the tubular neck (411) has a non-circular cross section corresponding to the drive rod (22). The optional label tab (44) is formed on the side surface of the tubular neck (41) and used for a tab attachment.

The adjustment knob (50) is mounted rotatably on the bottom surface (413) of the cavity (412) and has a top end (not numbered), a bottom end (not numbered), a side surface (not numbered), an inner cavity (not numbered), a drive slot (51), an annular flange (52), multiple detents (53) and a nut (54). The drive slot (51) is defined in the top end of the adjustment knob (50) and can be a transverse slot, a cross slot or a multiple shaped recess to accommodate a screwdriver tip. The annular flange (52) is defined around the bottom end of the adjustment knob (50), abuts the bottom surface (413) of the tubular neck (411) and has a diameter (not numbered). The multiple detents (53) are defined around the side surface near the annular flange (52). The nut (54) is mounted inside the inner cavity and is screwed with the threaded post (25) on the base (20).

The optional position ring (60) is mounted around the adjustment knob (50), is attached to the bottom surface (413) to hold the adjustment knob (50) and has an inner edge (not numbered), multiple through holes (not numbered), a central through hole (not numbered), two tongues (61) and multiple fasteners (not numbered). The central through hole has a diameter (not numbered) smaller than the diameter of the annular flange (52). The fasteners pass respectively through the multiple through holes and attach to the bottom surface (413) of the cavity (412) of the handle (40). The tongues (61) are formed on the inner edge of the position ring (60) opposite to each other and selectively extend into corresponding detents (53) to hold the adjustment knob (50) in place.

Figure 4:
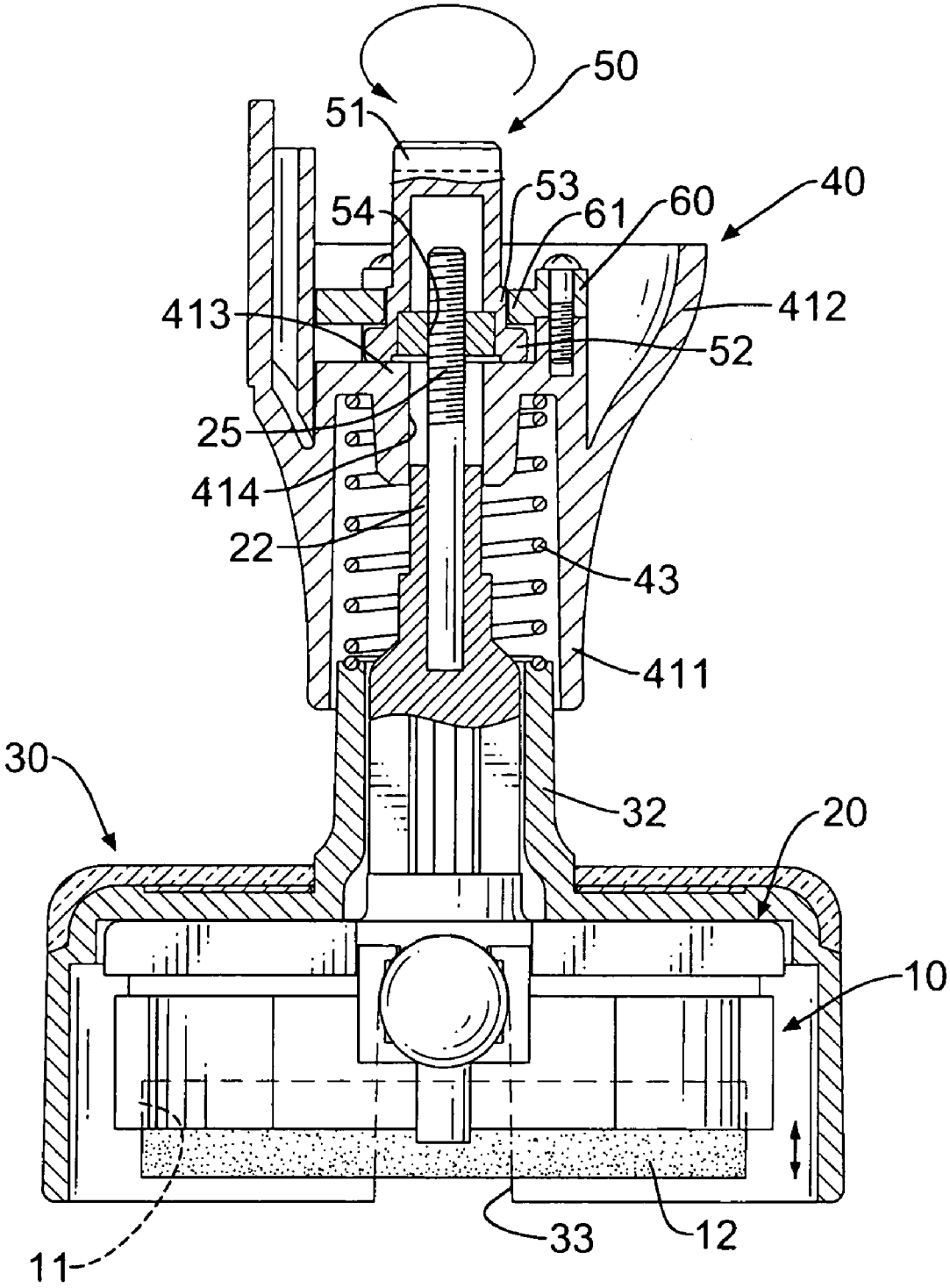
FIG. 4 is a side plan view in partial section of the stamp in FIG. 1 with the cover removed.

With reference to FIG. 4, the adjustment knob (50) is rotated to change the tension of the longitudinal spring (43) by drawing the handle (40) down onto the longitudinal spring (43) or releasing the handle (40).

Figure 5:
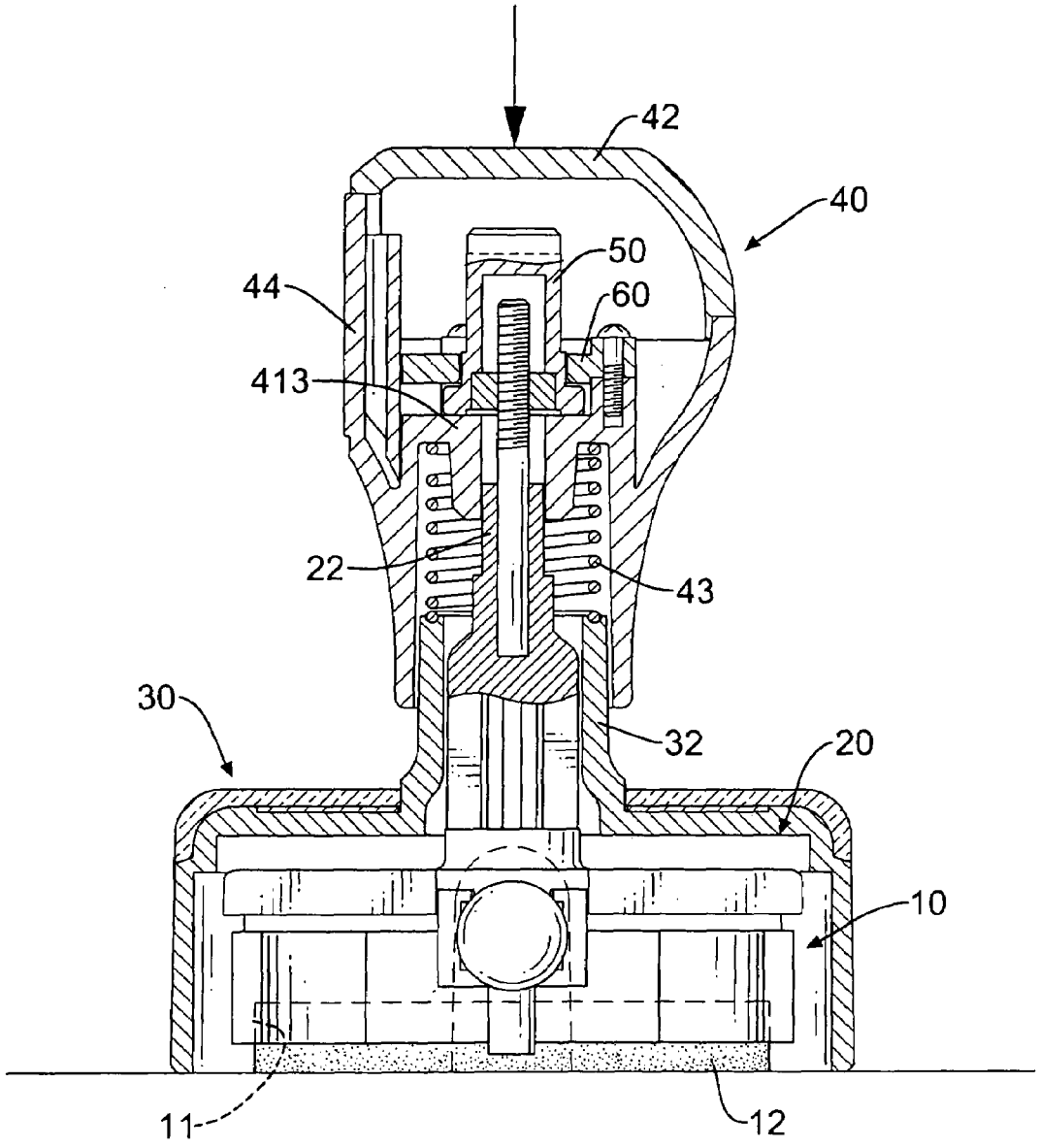
FIG. 5 is an operational side plan view in partial section of the stamp in FIG. 1 with the stamp depressed.

With reference to FIG. 5, the retractable stamp in accordance with the present invention stamps an imprint on a surface by placing the cover (30) in the desired position and pressing the handle (40) down. The handle (40) presses the drive rod (22), the base (20), the housing (10) and the character unit (12) down, and the character unit (12) makes contact with the surface and stamps an imprint on the surface. When the handle (40) is released, the longitudinal spring (43) pushes the handle (40) up and lifts the character unit (12) off the stamped surface.

A person can easily change the tension of the spring (43) in the retractable stamp in accordance with the present invention so the character unit (12) well makes a clear imprint.

Even though numerous characteristics and advantages of the present invention have been set forth in the foregoing description, together with details of the structure and function of the invention, that the disclosure is illustrative only, and changes may be made in detail, especially in matters of shape, size, and arrangement of parts within the principles of the invention to the full extent indicated by the broad general meaning of the terms in which the appended claims are expressed is to be understood.

What is claimed is:

1. An adjustable stamp having
- a housing having
  - a bottom surface,
  - a center,
  - a bottom cavity defined in the bottom surface of the housing,
  - an ink-impregnated foam pad mounted in the bottom cavity,
  - a character unit mounted on the ink-impregnated foam pad in the bottom cavity, and
  - an ink fill opening defined through the center of the housing and communicating with the bottom cavity,
- a base mounted on the housing and having
  - a top surface,
  - a center,
  - a drive rod formed on the top surface at the center of the base and having a top end, a non-circular cross section and multiple side surfaces, and
  - a threaded post mounted on the top end of the drive rod,
- a cover mounted on the housing and the base and having
  - a top surface, and
  - a tube formed on the top surface at the center of the cover and having an inner surface and a top,
- a handle mounted slidably on the cover and having
  - a top portion,
  - a bottom portion,
  - a tubular neck mounted slidably on the tube of the cover, formed on the bottom portion of the handle and having
    - a top end,
    - a cavity defined on the top end of the tubular neck,
    - a bottom surface,
    - a central hole defined through the bottom surface to allow the drive rod to pass moveably through the tubular neck and having a noncircular cross section corresponding to the drive rod, and
    - a longitudinal spring mounted inside the tubular neck between the top end of the tubular neck and the top of the tube on the cover,
- an adjustment knob mounted rotatably on the bottom surface of the cavity and having
  - a top end,
  - a bottom end,
  - an inner cavity,
  - a drive slot defined on the top end of the adjustment knob,
  - an annular flange defined around the bottom end of the adjustment knob and abutting the bottom surface of the tubular neck and having a diameter, and
  - a nut mounted inside the inner cavity and screwed with the threaded post on the base.

2. The adjustable stamp as claimed in claim 1, wherein the adjustable stamp further comprises a bottom surface and a position ring mounted around the adjustment knob, attached to the bottom surface to hold the adjustment knob against the bottom surface and having
- an inner edge,
- multiple through holes,
- a central through hole having a diameter that is smaller than the diameter of the annular flange on the adjustment knob, and
- multiple fasteners passing respectively through the multiple through holes and attached to the bottom surface of the cavity of the handle.

3. The adjustable stamp as claimed in claim 2, wherein the adjustment knob further comprises a side surface, multiple detents defined around the side surface near the annular flange, and the position ring further comprises two tongues formed on the inner edge of the position ring opposite to each other and selectively extending into two of the detents to hold the adjustment knob in place.

4. The adjustable stamp as claimed in claim 1, wherein the drive slot in the adjustment knob is a transverse slot.

5. The adjustable stamp as claimed in claim 2, wherein the drive slot in the adjustment knob is a transverse slot.

6. The adjustable stamp as claimed in claim 3, wherein the housing further comprises a side surface, two peripheral chambers defined on the side surface of the housing, two pushbuttons moveably received respectively in the peripheral chambers and each pushbutton having an inner end pressing the outer end of the corresponding spring, an outer end, a keyhole transversely defined through the pushbutton, and a head formed on the outer end of the pushbutton, and two springs mounted respectively inside the peripheral chambers and each spring having an inner end and an outer end abutting against a corresponding on of the pushbuttons, the base further comprises an upper side edge, two latches formed on the upper side edge, extending toward the housing, mounted respectively in the keyholes in the pushbuttons and hooking respectively with the pushbuttons, and the cover further comprises a side surface, two longitudinal U-shaped openings defined in the side surface and allow the pushbuttons to extend through the side surface.

7. The adjustable stamp as claimed in claim 6, wherein the base further comprises multiple keys formed respectively on the side surfaces of the drive rod, and the tube of the cover further comprises an inner surface and multiple keyways defined on the inner surface of the tube and corresponding to the keys on the drive rod.

8. The adjustable stamp as claimed in claim 7, wherein the handle further comprises a label tab formed on the side surface of the tubular neck.

9. The adjustable stamp as claimed in claim 8, wherein the handle further comprises a cap mounted on the top portion of the tubular neck.

10. The adjustable stamp as claimed in claim 1, wherein the housing further comprises two peripheral chambers defined on the side surface of the housing, two pushbuttons moveably received respectively in the peripheral chambers and each pushbutton having an inner end pressing the outer end of the corresponding spring, an outer end, a keyhole transversely defined through the pushbutton, and a head formed on the outer end of the pushbutton, and two springs mounted respectively inside the peripheral chambers and each spring having an inner end and an outer end abutting against a corresponding one of the pushbuttons, the base further comprises two latches formed on the upper side edge, extending toward the housing, mounted respectively in the keyholes in the pushbuttons and hooking respectively with the pushbuttons, and the cover further comprises two longitudinal U-shaped openings defined in the side surface and allowing the pushbuttons to extend through the side surface.

11. The adjustable stamp as claimed in claim 1, wherein the base further comprises multiple keys formed respectively on the side surfaces of the drive rod, and the tube of the cover further comprises multiple keyways defined on the inner surface of the tube and corresponding to the keys on the drive rod.

12. The adjustable stamp as claimed in claim 1, wherein the handle further comprises a label tab formed on the side surface of the tubular neck.

13. The adjustable stamp as claimed in claim 1, wherein the handle further comprises a cap mounted on the top portion of the tubular neck.

* * * * *